United States Patent [19]

Butler et al.

[11] Patent Number: 4,565,258

[45] Date of Patent: Jan. 21, 1986

[54] STEREO HEADSET SYSTEM FOR USE IN A WET ENVIRONMENT

[76] Inventors: Donald F. Butler, 2404 Nearcliff St., Torrance, Calif. 90505; Mark E. Shelton, 2020 Gibraltar Rd., Landers, Calif. 92284

[21] Appl. No.: 638,396

[22] Filed: Aug. 7, 1984

[51] Int. Cl.[4] ..... H04R 25/00

[52] U.S. Cl. ..... 181/129; 181/141; 181/145; 181/149; 179/156 R; 381/25

[58] Field of Search ..... 181/129, 130, 131, 135, 181/141, 145, 149; 381/25, 63; 179/156 R; 4/543, 541; 5/400, 451

[56] References Cited

U.S. PATENT DOCUMENTS

| | | | |
|---|---|---|---|
| 3,547,219 | 12/1970 | Bothos | 181/135 |
| 3,789,164 | 1/1974 | Ryder | 179/156 R |
| 4,087,629 | 5/1978 | Atoji et al. | 381/63 |
| 4,114,215 | 9/1978 | Santo | 5/400 |
| 4,220,984 | 9/1980 | Truher et al. | 5/451 X |
| 4,347,405 | 8/1982 | Davis | 381/25 |
| 4,430,762 | 2/1984 | Marshall | 4/543 |

*Primary Examiner*—Benjamin R. Fuller
*Attorney, Agent, or Firm*—W. Edward Johansen

[57] ABSTRACT

The present invention is a stereo headset system for use with a stereo headset device and a stereo sound system. The stereo headset device is of the stethoscope type and has a pair of sound tubular mains. A coupling plug is mechanically and acoustically coupled to the pair of sound tubular mains. The stereo headset system includes an enclosure having a first chamber, a second chamber, a third chamber and a fourth chamber. The first and second chambers are mechanically and acoustically coupled to the coupling plug of the stereo headset device. A first electro-acoustic transducer is disposed in the third chamber of the enclosure and is acoustically coupled to the first chamber of the enclosure. A second electro-acoustic transducer is disposed in the fourth chamber of the enclosure and is acoustically coupled to the second chamber of the enclosure. The third and fourth chambers of the enclosure are water-proofed. A control unit includes a double pole relay and a double potentiometer both of which electrically couple in series the two output channels of the stereo sound system to the first and second electro-acoustic transducers so that the stereo headset system is able to transmit sounds from the stereo sound system through the stereo headset device to an individual who is in a wet environment during both social and recreational periods.

1 Claim, 8 Drawing Figures

Fig. 1.
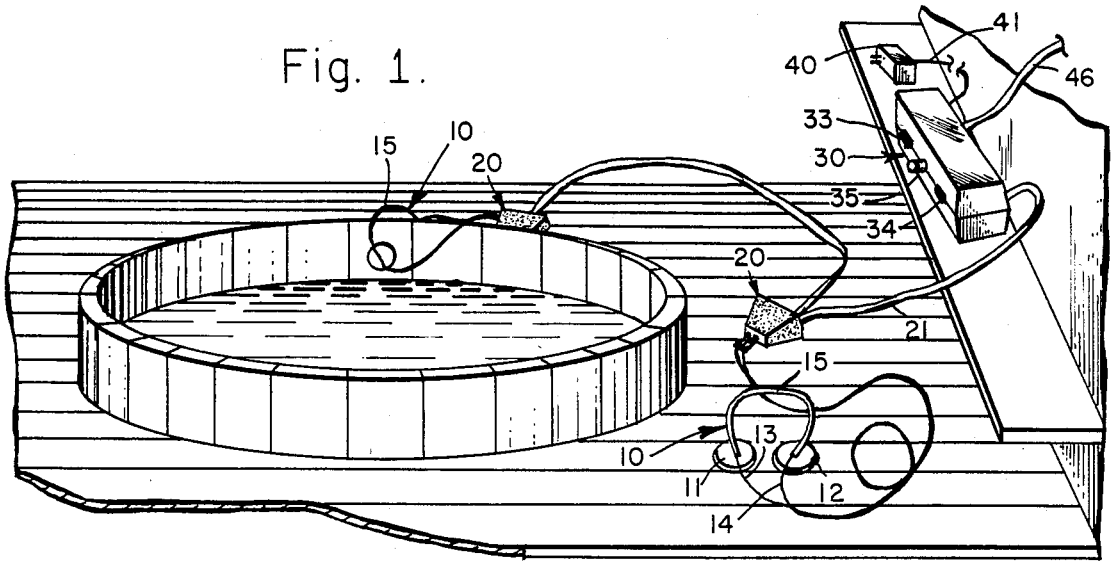
Fig. 5.
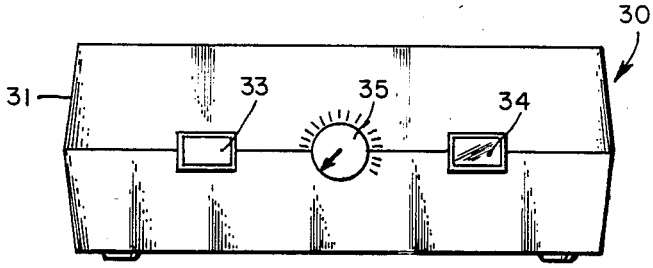
Fig. 7.
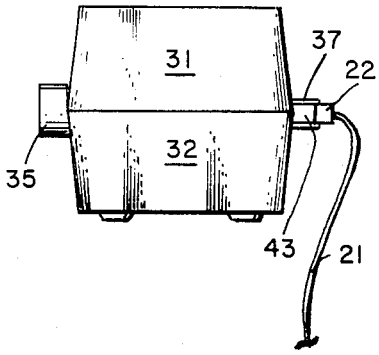
Fig. 6.
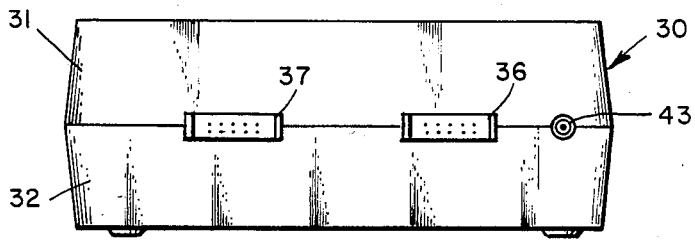
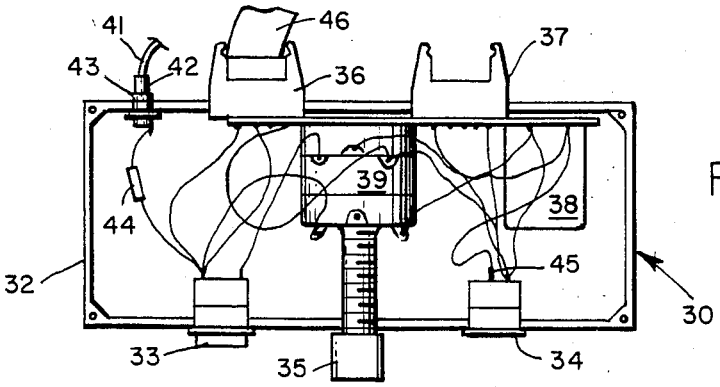
Fig. 8.

Fig. 2.
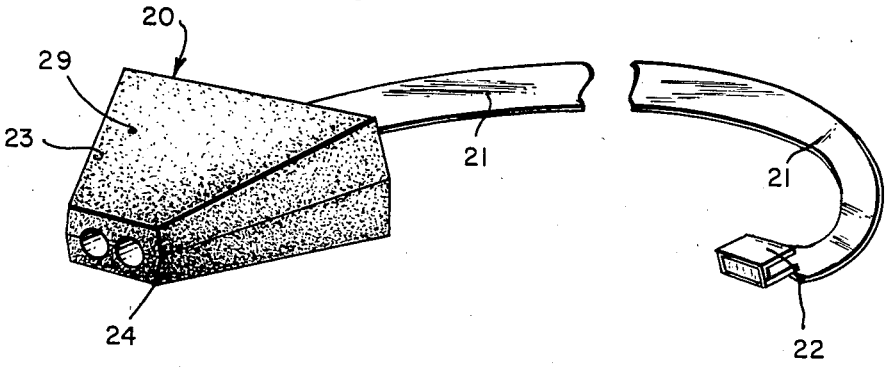
Fig. 4.
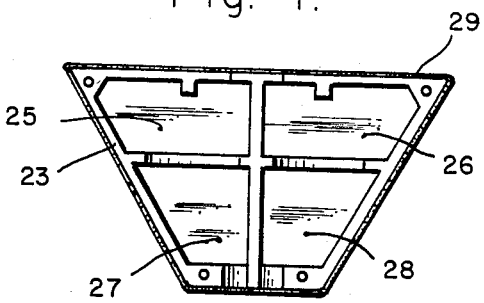
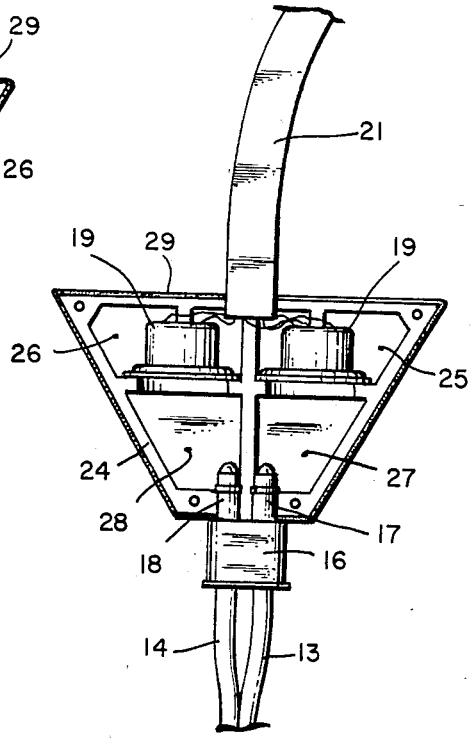
Fig. 3.

STEREO HEADSET SYSTEM FOR USE IN A WET ENVIRONMENT

BACKGROUND OF THE INVENTION

1. Field of the Invention

The present invention relates to a stereo headset system for use with a stereo sound system during both social and recreational periods and more particularly to a stereo headset system which is used to transmits sounds from a stereo sound system to a plurality of individuals who are in a wet environment, such as either a hottub or a sauna bath.

2. Description of the Prior Art

U.S. Pat. No. 3,547,219, entitled Headset Device, issued to Costas Bothos on Dec. 15, 1970, teaches headset devices of the stethoscope type which are for use with a sound system wherein the sound is conducted or "piped" from a sound source through sound tubular mains. Such sound systems are employed in aircraft which is provided with motion pictures and stereo music while the aircraft is in flight. The sound is piped through the sound tubular mains extending along the walls of the aircraft. The sound tubular mains are provided with outlets adjacent the rows of the passenger seats. The headset devices are plugged into these outlets. Each headset device is provided with rotatable earpieces permitting adjustment to the ear canal angles of the listener. The earpieces are provided with amplifier cavities. A plug of improved construction is used to connect the hearing tubes to the sound source through the sound tubular mains so that its full sound passes unimpeded to the earpieces of each headset device.

U.S. Pat. No. 4,347,405, entitled Sound Reproducing Systems Utilizing Acoustic Processing Unit, issued to Lanny C. Davis on Aug. 31, 1982, teaches a system for reproducing two sets of electro-acoustic signals for use in combination with a stereo headsets device having a pair of earpieces. The system includes an enclosure in which a pair of electro-acoustic transducers are disposed in order to convert electro-acoustic signals to a set of mechanical-acoustic signals which are transmitted to the earpieces of the stereo headset device.

U.S. Pat. No. 4,087,629, entitled Binaural Sound Reproducing System with Acoustic Reverberation Unit, issued to Nobuhisa Atoji and Takahisa Aoi on May 2, 1978, teaches a binaural sound reproducing system for transmitting sound radiated from an electro-acoustic transducer through a sound wave transmission path such as a pipe to the left and right ears of a listener includes a mechanical-acoustic element. The binaural sound reproducing system includes a stereo headset device with a pair of earpieces and a pair of sound tubular mains. The binaural sound reproducing system also includes a stereo signal source such as a tape recorder, a tuner, a record player or the like, a pair of amplifiers and a pair of electro-acoustic transducers each of which is acoustically coupled to one of the earpieces.

U.S. Pat. No. 3,789,164, entitled Earphone Assembly, issued to Robert Ryder on Jan. 29, 1974, teaches an earphone assembly of the pneumatic type such as presently used on aircraft and which is constructed to improve reproduction quality of the instrument by providing high frequency transducers directly at the ear pieces for producing high frequency sound signal which would otherwise be attentuated in the flexible plastic tubes coupling the ear pieces to the main electro-acoustic transducer.

U.S. Pat. No. 4,430,762, entitled Aquassage, issued to Mark Marshall on Feb. 14, 1984, teaches an improved water areator which is immersible in a tub of water and which directs jets of air into the water in order to produce either a hydrotherapeutic effect or a recreational effect. The improved water areator has a flexible, soft tubing which is pliable enough to be bent into different configurations. The tubing has a plurality of perforations which allow compressed air to be horizontally interjected therethrough into the water.

U.S. Pat. No. 4,114,215, entitled Unitary Accessory Control for a Waterbed, issued to Phillip J. Santo on Sept. 19, 1978, teaches a unitary accessory control which is fixed to the frame of a waterbed. Within the unitary accessory control are such accessories as a pump for filling and emptying the waterbed, a heater, a vibrator, a sound system and a mechanism for controlling the environment of the room in which the waterbed is located.

U.S. Pat. No. 4,220,984, entitled Illumination Device for a Waterbed, issued to Michael B. Truher and Sheryl L. Truher on Sept. 2, 1980, teaches an illumination device for use in combination with a waterbed with a plastic membrane which takes the shape of a mattress when it is filled with water. The illumination device includes a lamp which provides light and a prism-shaped container which optically couples the light from the lamp through a glass sidewall to the water in the plastic membrane.

SUMMARY OF THE INVENTION

In view of the foregoing factors and conditions which are characteristic of the prior art it is the primary object of the present invention to provide a stereo headset system which is used with a stereo sound system to transmits sounds to a plurality of individuals who are in a wet environment, such as either a hottub or a sauna bath during both social and recreational periods.

In accordance with the present invention an embodiment of a stereo headset system for use with a stereo headset device and a stereo sound system is described. The stereo headset device is of the stethoscope type and has a pair of sound tubular mains. A coupling plug is mechanically and acoustically coupled to the pair of sound tubular mains. The stereo headset system includes an enclosure having a first chamber, a second chamber, a third chamber and a fourth chamber. The first and second chambers are mechanically and acoustically coupled to the coupling plug of the stereo headset device. A first electro-acoustic transducer is disposed in the third chamber of the enclosure and is acoustically coupled to the first chamber of the enclosure. A second electro-acoustic transducer is disposed in the fourth chamber of the enclosure and is acoustically coupled to the second chamber of the enclosure. The third and fourth chambers of the enclosure are water-proofed. A control unit includes a double pole relay and a double potentiometer both of which electrically couple in series the two output channels of the stereo sound system to the first and second electro-acoustic transducers so that the stereo headset system is able to transmit sounds from the stereo sound system through the stereo headset device to an individual who is in a wet environment during both social and recreational periods.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE DRAWING

FIG. 1 is a perspective drawing of a hot tub having a stereo headset system which is used with a stereo sound system during both social and recreational periods in a hottub and which has been constructed in accordance with the principles of the present invention.

FIG. 2 is a perspective drawing of an electro-acoustic coupler of the stereo headset system of FIG. 1.

FIG. 3 is a top plan view of the bottom half of the enclosure for the electro-acoustic coupler of FIG. 2 showing a pair of electro-acoustic transducers disposed therein.

FIG. 4 is a bottom plan view of the top half of the enclosure for the electro-acoustic coupler of FIG. 2.

FIG. 5 is a front elevational view of a control unit of the stereo headset system of FIG. 1.

FIG. 6 is a rear elevational view of the control unit of FIG. 5.

FIG. 7 is a side elevational view of the control unit of FIG. 5.

FIG. 8 is a top plan view of the bottom half of the control unit of FIG. 5 showing the electrical components thereof.

DESCRIPTION OF THE PREFERRED EMBODIMENT

In order to best understand the present invention it is necessary to refer to the following description of its preferred embodiment in conjunction with the figure of accompanying drawing. Referring to FIG. 1 a stereo headset system for use with a stereo sound system which is a binaural sound reproducing system and a stereo headset device 10 which is of the stethoscope type and which includes a first earpiece 11 and a second earpiece 12 both of which have amplifier cavities. The stereo headset device 10 also includes a first sound tubular main 13 and a second sound tubular main 14 both of which are mechanically and acousically coupled to the first and second earpieces 11 and 12, respectively, and both of which are also mechanically coupled to a headset frame 15. The first and second earpieces 11 and 12 are rotatably coupled to the headset frame 15 in order to permit their adjustments to the ear canal angles of the listener. U.S. Pat. No. 3,547,219 teaches a stereo headset device which is used with a sound system to conduct or "pipe" sound from a sound source. The stereo sound system includes a stereo signal source such as a tape recorder, a tuner, a record player or the like, a pair of amplifiers. U.S. Pat. No. 4,087,629 teaches a binaural sound reproducing system which transmits sound which is radiated from an electro-acoustic transducer through a sound wave transmission path such as a pipe to the left and right ears of a listener. The binaural sound reproducing system includes a stereo headset device with a pair of earpieces and a pair of sound tubular mains.

Referring to FIG. 1 in conjunction with FIG. 2 and FIG. 3 a plug 16 has a first male connector 17 and a second male connector 18 which are mechanically and acoustically coupled to the first and second tubular mains 13 and 14, respectively. The plug 16 is used to connect the first and second earpieces 11 and 12 to the sound source through the first and second sound tubular mains 13 and 14 and a pair of electro-acoustic transducers 19 so that its full sound passes unimpeded to the first and second earpieces 11 and 12 of each stereo headset device 10.

Referring to FIG. 2 in conjunction with FIG. 1, FIG. 3 and FIG. 4 the stereo headset system includes an electro-acoustic coupler 20 which has a cable 21 with a female-pin connector 22. The cable 21 is electrically coupled to the pair of electro-acoustic transducers 19. The electro-acoustic coupler 20 includes an enclosure which has a top half section 23 and a bottom half section 24. The enclosure has first chamber 25, a second chamber 26, a third chamber 27 and a fourth chamber 28. The pair of electro-acoustic transducers 19 are disposed in the first and second chambers 25 and 26. Each of the pair of electro-acoustic transducers 19 is acoustically coupled to one of the first and second earpieces 11 and 12. One of the electro-acoustic transducers 19 is disposed in the first chamber 25 of the enclosure and is acoustically coupled to the third chamber 27 thereof. The other electro-acoustic transducer 19 is disposed in the second chamber 26 of the enclosure and is acoustically coupled to the fourth chamber 28 thereof. The first and second chambers 25 and 26 of the enclosure are water-proofed by a coating of rubber cement 29 and a mylar face of each transducer 19. The third and fourth chambers 27 and 28 are mechanically and acoustically coupled to the coupling plug 16 of the stereo headset device 10. U.S. Pat. No. 4,347,405 teaches a system for reproducing two sets of electro-acoustic signals for use in combination with a stereo headset device having a pair of earpieces. The system includes an enclosure in which a pair of electro-acoustic transducers are disposed in order to convert electro-acoustic signals to a set of mechanical-acoustic signals which are transmitted to the earpieces of the stereo headset device.

Referring to FIG. 5 in conjunction with FIG. 1, FIG. 6, FIG. 7 and FIG. 8 the stereo headset system also includes a control unit 30. The enclosure of the control unit 30 includes a top half section 31 and a bottom half section 32. The control unit 30 has disposed on its front panel an on/off switch 33, a light 34 which indicates when the control unit 30 is turned on and a volume control knob 35 by which the listener can control the volume level of the stereo sound system. The control unit 30 also has disposed on its rear panel an input male pin-connector 36 and an output male pin-connector 37 which is electrically coupled to the cable 21 by the female pin-connector 22. The control unit 30 also includes a double pole relay 38 and a double potentiometer 39 both of which electrically couple in series the two output channels of the stereo sound system to the pair of electro-acoustic transducers 19.

Referring to FIG. 8 in conjunction with FIG. 1 the stereo headset system also includes a transformer 40 which is coupled to an electrical outlet in order to provide electrical power. The transformer 40 has an outlet cable 41 with a male pin-connector 42. The control unit 30 has disposed on its rear panel a female pin-connector 43 which is mechanically and electrically coupled to the male pin-connector 42. The female pin-connector 43 is electrically coupled to the double pole relay 38 through a resistor 44 and a diode 45. A cable and female pin-connector 46 electrically couples the stereo sound system to the input male pin-connector 36.

From the foregoing it can be seen that a stereo headset system for use with a stereo headset device and a stereo sound system during both social and recreational periods in a wet environment such as either a hottub or a sauna has been described. It should be noted that the sketch is not drawn to scale and that distances of and between the figures are not to be considered significant.

Accordingly it is intended that the foregoing disclosure and showing made in the drawing shall be considered only as an illustration of the principles of the present invention.

What is claimed is:

1. A stereo headset system for use with a stereo sound system and a stereo headset device of the stethoscope type having a pair of sound tubular mains and a coupling plug which is mechanically and acoustically coupled to the pair of sound tubular mains, said stereo headset system comprising:

a. an enclosure having a first chamber, a second chamber, a third chamber and a fourth chamber with said third and fourth chambers being mechanically and acoustically coupled to the coupling plug of the stereo headset device;

b. a first electro-acoustic transducer which is disposed in said first chamber of said enclosure and which is acoustically coupled to said third chamber of said enclosure;

c. a second electro-acoustic transducer which is disposed in said second chamber of said enclosure and which is acoustically coupled to said fourth chamber of said enclosure;

d. water-proofing means for water-proofing said first and second chambers of said enclosure; and e. electro-coupling means for electrically coupling said first and second electro-acoustic transducers to the stereo sound system whereby said stereo headset system transmits sounds from the stereo sound system through the stereo headset device to an individual who is in a wet environment during both social and recreational periods.

* * * * *